US007866851B2

(12) United States Patent
Chang

(10) Patent No.: US 7,866,851 B2
(45) Date of Patent: Jan. 11, 2011

(54) LED HEAT SINK

(76) Inventor: Tong-Lung Chang, No. 115, Fanzihtian, Danshuei Chen, Taipei Hsien (TW)

( * ) Notice: Subject to any disclaimer, the term of this patent is extended or adjusted under 35 U.S.C. 154(b) by 287 days.

(21) Appl. No.: 12/157,264

(22) Filed: Jun. 9, 2008

(65) Prior Publication Data

US 2009/0303725 A1 Dec. 10, 2009

(51) Int. Cl.
*F21V 29/00* (2006.01)

(52) U.S. Cl. ..... 362/294; 362/800; 362/555; 362/373; 362/249.01; 362/249.02; 362/551

(58) Field of Classification Search ..... 362/294, 362/373, 800, 551, 555, 249.01–249.06
See application file for complete search history.

(56) References Cited

U.S. PATENT DOCUMENTS 7,440,280 B2 * 10/2008 Shuy ..... 361/701
7,553,047 B2 * 6/2009 Shin et al. ..... 362/294
2008/0205062 A1 * 8/2008 Dahm et al. ..... 362/294

* cited by examiner

*Primary Examiner*—Sandra L O Shea
*Assistant Examiner*—Jessica L McMillan
(74) *Attorney, Agent, or Firm*—WIlliam E. Pelton, Esq.; Cooper & Dunham LLP

(57) ABSTRACT

An LED heat sink having an LED unit and a pipe. The LED unit has a base having a top and an LED chip attached to the top of the base. The pipe has a inlet end, a outlet end, a body, multiple inlets, multiple partitioning walls and multiple partitions. The inlet end is attached to the base of the LED unit. The inlets are defined near the base. The partitioning walls are formed inside the body. The partitions are defined within the body by the partitioning walls and communicate with the inlet end.

6 Claims, 8 Drawing Sheets

LED HEAT SINK

BACKGROUND OF THE INVENTION

1. Field of the Invention

The present invention relates to a heat sink, especially to an LED heat sink.

2. Description of the Prior Art

Low power Light-emitting diodes (LEDs) are low power-consuming, low heat-producing and long life. When low-power LEDs are used, slight heat is generated that is transferred to a local environment without dissipation problems. However, a high-power LED generates greater quantities of heat at greater intensity, which is not easily transferred to the local environment. If the heat is not dissipated and accumulates, the high-power LED is damaged causing a shortened lifespan or terminal failure.

Therefore, with reference to FIG. 9, a conventional high-power LED device comprising a high-power LED unit (80), a conductive block (91) and a heat sink (92) is developed to solve the aforementioned problem.

The high-power LED unit (80) has a base (81) and a high-power LED chip (82) attached to the base (81), covered by a resin material. To enhance heat transfer, the base (81) is attached to the conductive block (91) and the conductive block (91) is attached to the heat sink (92). The conductive block (91) has an outer surface larger than that of the base (81). Heat generated by the high-power LED device in use is transferred to the conductive block (91) through the base (81) and then spread by the conductive block (91) and transferred to the heat sink (92) that has an outer surface being larger than the conductive block (91) and multiple fins formed on an inner surface, therefore, being more effective at dissipation.

However, the dissipation by the conductive block (91) and the heat sink (92) is significantly limited. When combining multiple high-power LED units (80), a total surface of the conductive block (91) and the heat sink (92) will be unfeasibly large. Furthermore, air flows in random directions over the heat sink (92) and through its fins, thereby inhibiting an air-cooling effect thereof.

To overcome the shortcomings, the present invention provides an LED heat sink to mitigate or obviate the aforementioned problems.

SUMMARY OF THE INVENTION

The main objective of the invention is to provide an LED heat sink.

The LED heat sink in accordance with the present invention has an LED unit and a pipe. The LED unit has a base having a top and an LED chip attached to the top of the base. The pipe has an inlet end, an outlet end, a body, multiple inlets, multiple partitioning walls and multiple partitions. The inlet end is attached to the base of the LED unit. The inlets are defined near the base. The partitioning walls are formed inside the body. The partitions are defined within the body by the partitioning walls and communicate with the inlet end and the outlet end.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
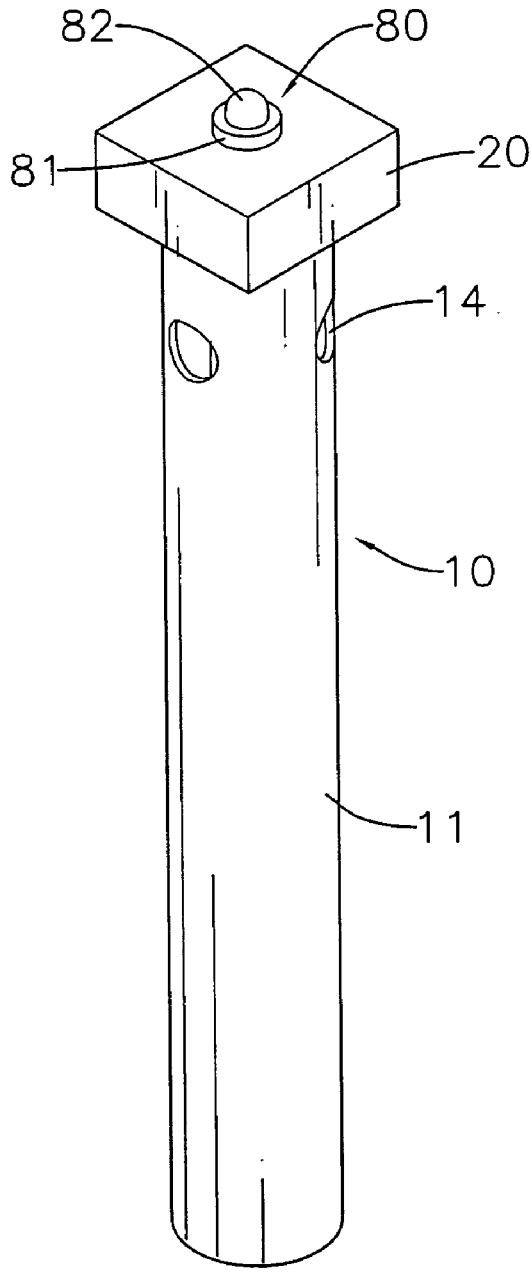
FIG. 1 is a perspective view of a first embodiment of an LED heat sink in accordance with the present invention.

With reference to FIG. 1, a light emitting diode (LED) heat sink in accordance with the present invention has an LED unit (80) and a pipe (10).

The pipe (10) has two ends and multiple inlets (14). One end of the pipe (10) is mounted on the LED unit (80). The inlets (14) are defined in the pipe (10), near the LED unit (80).

Figure 2:
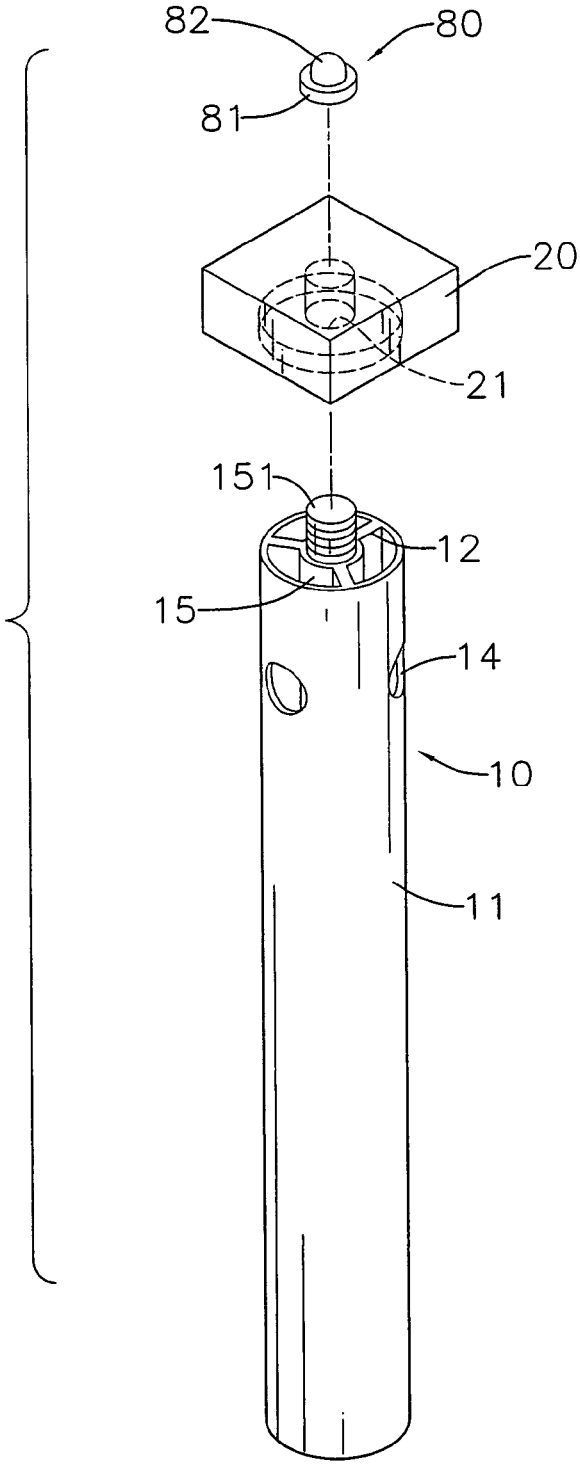
FIG. 2 is an exploded perspective view of the LED heat sink in FIG. 1.
Figure 3:
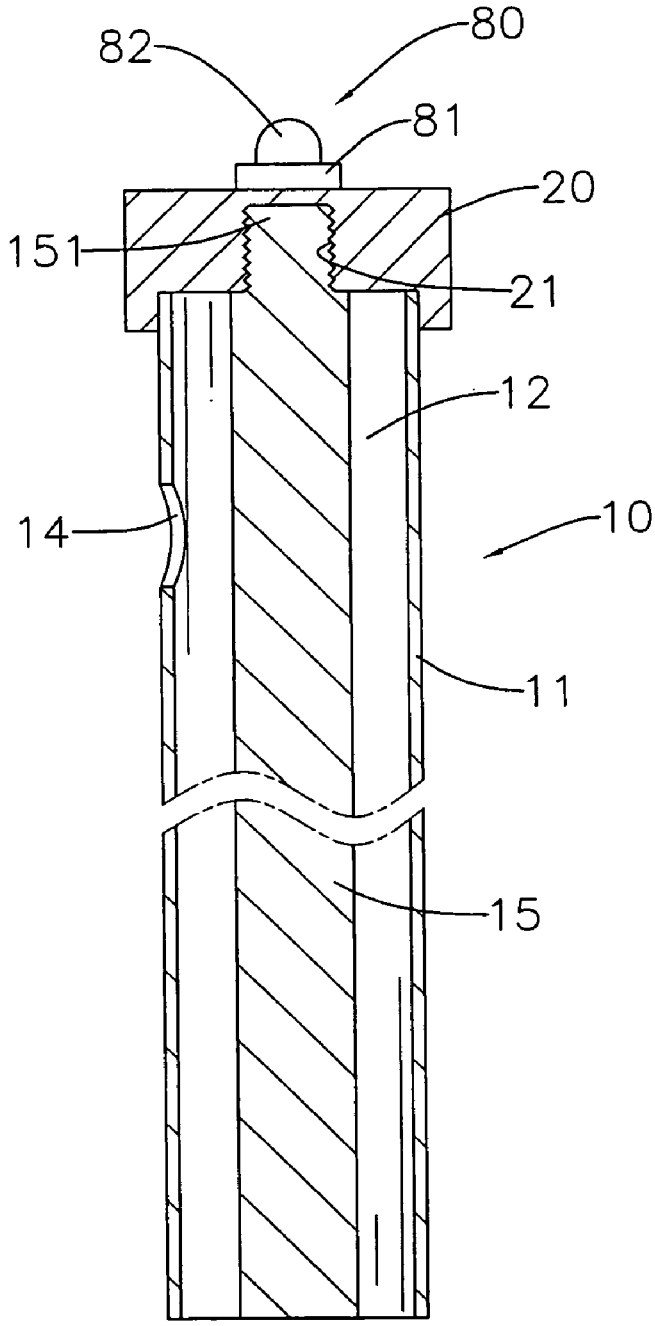
FIG. 3 is a side view in partial section of the LED heat sink in FIG. 1.

With further reference to FIGS. 2 and 3, the LED unit (80) has a base (81) and an LED chip (82) attached to the base (81). The LED chip (82) may be embedded in a transparent material, such as but not limited to resin or plastic, to protect the LED chip (82). The transparent material may be convexly formed and act as a lens to disperse light produced by the LED chip (82). The base (81) may be a cylinder and has an inner surface.

The pipe (10) is a hollow tube and has an inlet end, an outlet end, a body (11), multiple optional inlets (14), an axis (15) and multiple partitioning walls (12).

The inlet end of the pipe (10) is mounted on the base (81) of the LED unit (80) and may comprise a conducting block (20). The conducting block (20) is mounted securely on the inlet end of the pipe (10), may be a parallelepiped or a cylinder and has an inner surface and an outer surface. The outer surface of the conducting block (20) is attached to the LED unit (80). The inner surface of the conducting block (20) may have a recess having a shaft recess (21) formed centrally therein, the shaft recess (21) may be threaded.

Figure 8:
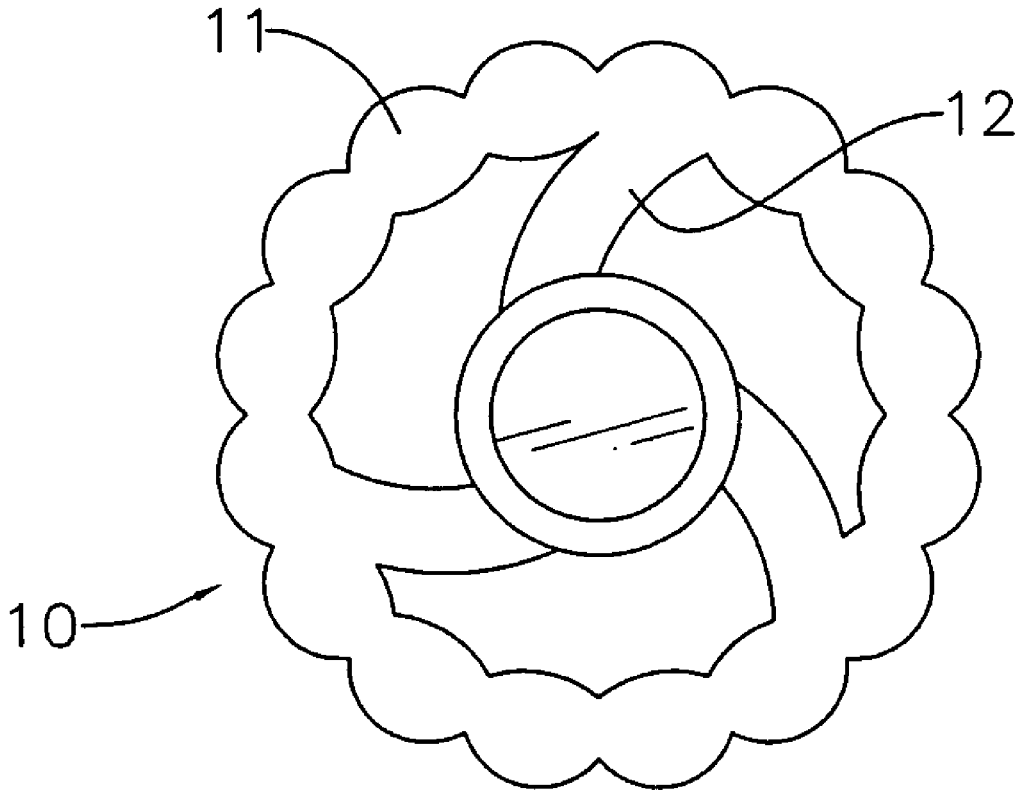
FIG. 8 is a sectional top view of a third embodiment of the LED heat sink in accordance with the present invention.
Figure 9:
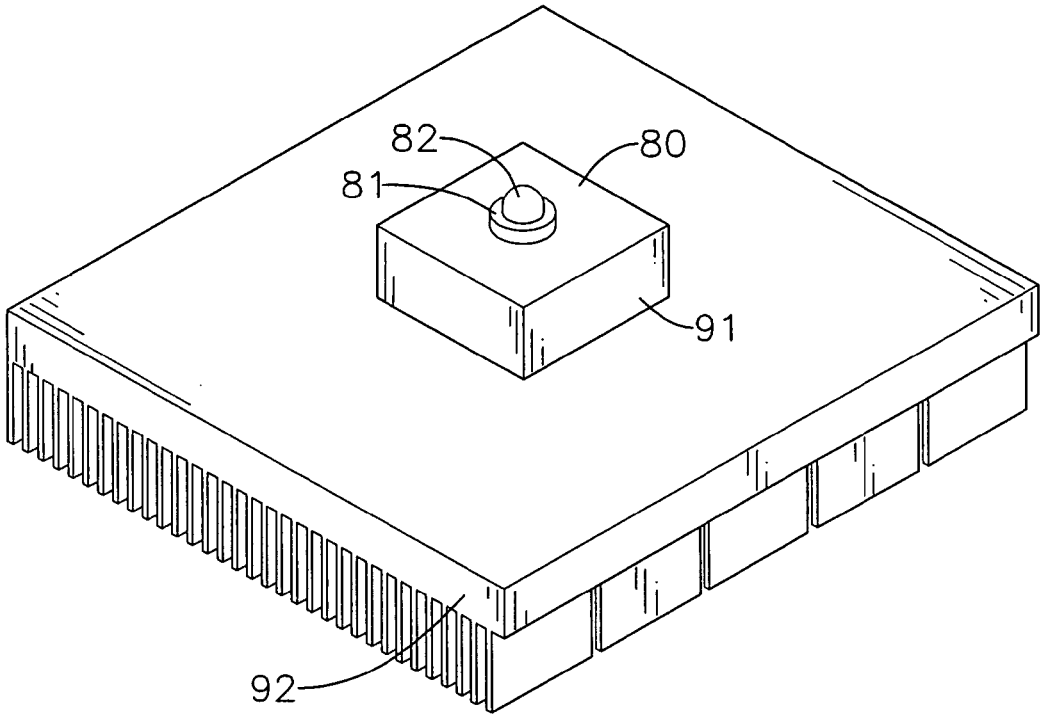
FIG.9 PRIOR ART
FIG. 9 is a perspective view of a conventional high-power LED device in accordance with the prior art.

With further reference to FIG. 8, the body (11) has inner and outer surfaces, which may be irregular, preferably, concertained or the like for increased total surface area.

The multiple inlets (14) are defined through the body (11) near the inlet end.

The axis (15) is longitudinally formed through a center of the pipe (10), is enclosed by the body (11), may be cylindrical and may comprise a shaft (151). The shaft (151) is formed on the axis (15), protrudes from the inlet end of the pipe (10), is mounted on the conducting block (20) and has an outer surface, may correspond to and be mounted in the recess of the conducting block (20) and in the shaft recess (21), may be threaded on the outer surface and engage the shaft recess (21) and may be attached to the base (81) of the LED unit (80).

Figure 4:
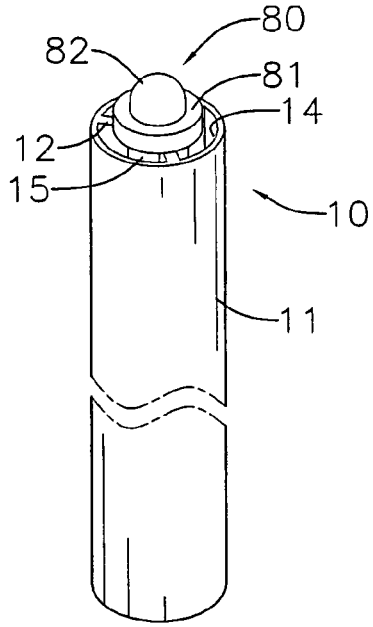
FIG. 4 is a perspective view of a second embodiment of the LED heat sink in accordance with the present invention.
Figure 5:
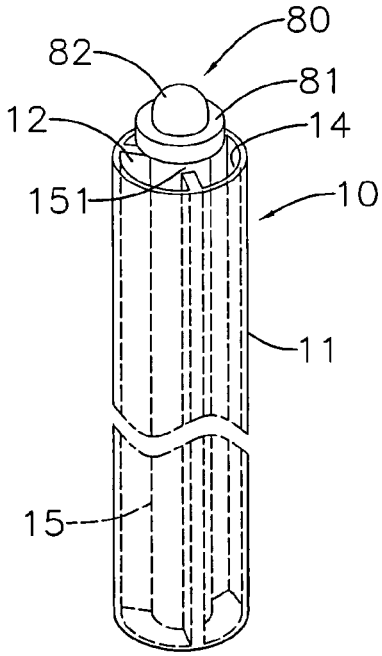
FIG. 5 is a perspective view of the LED heat sink in FIG. 4, with internal elements of a pipe shown in phantom lines.

With further reference to FIGS. 4 and 5, the partitioning walls (12) may be curved, are formed on and protrude radially from the axis (15) and are attached to the inner surface of the body (11) to form multiple partitions. The partitions are defined longitudinally through the pipe (10) and may communicate respectively with the inlets (14). When the LED unit (80) is mounted directly on the inlet end of the pipe (10), a gap is formed therebetween corresponding to the partitions.

With reference to the structures disclosed by the aforementioned embodiments, a structure demonstrating the concept disclosed by the present invention wherein a cooling air is allowed to flow into the pipe (10) does not depart from the present invention.

Figure 6:
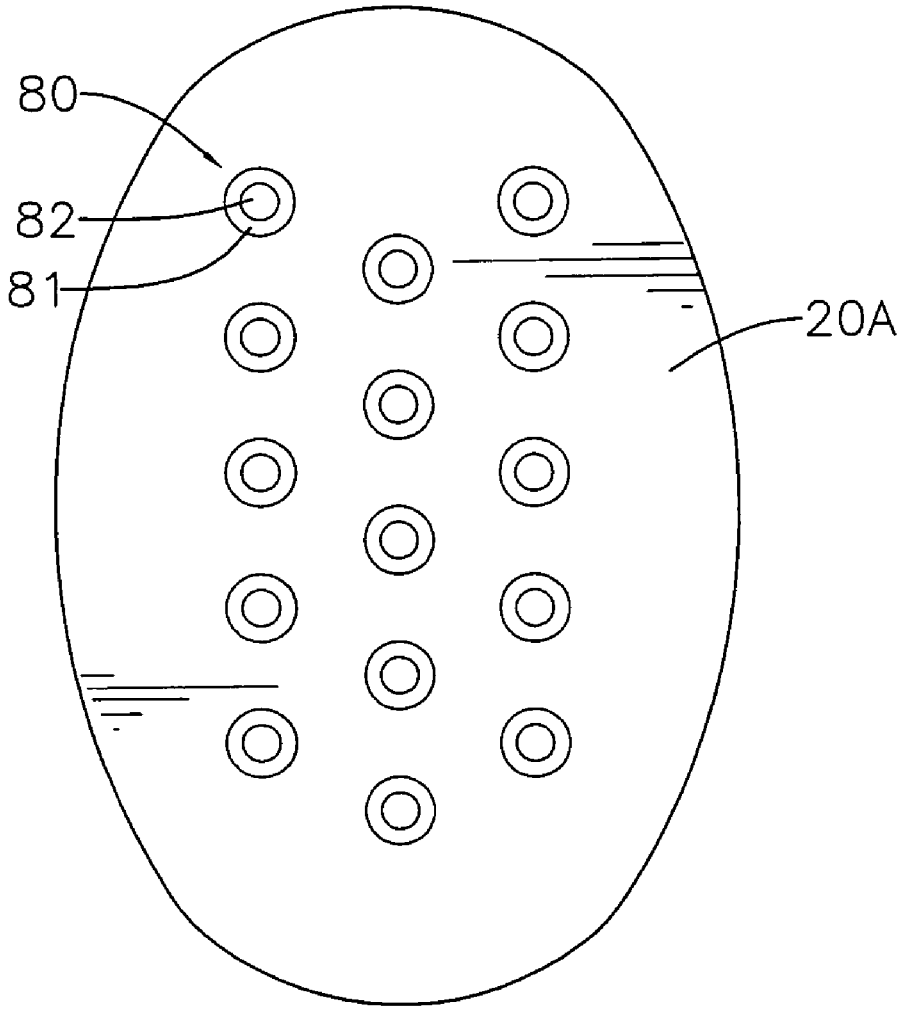
FIG. 6 is a bottom view of a streetlight comprising multiple LED heat sinks in accordance with the present invention.
Figure 7:
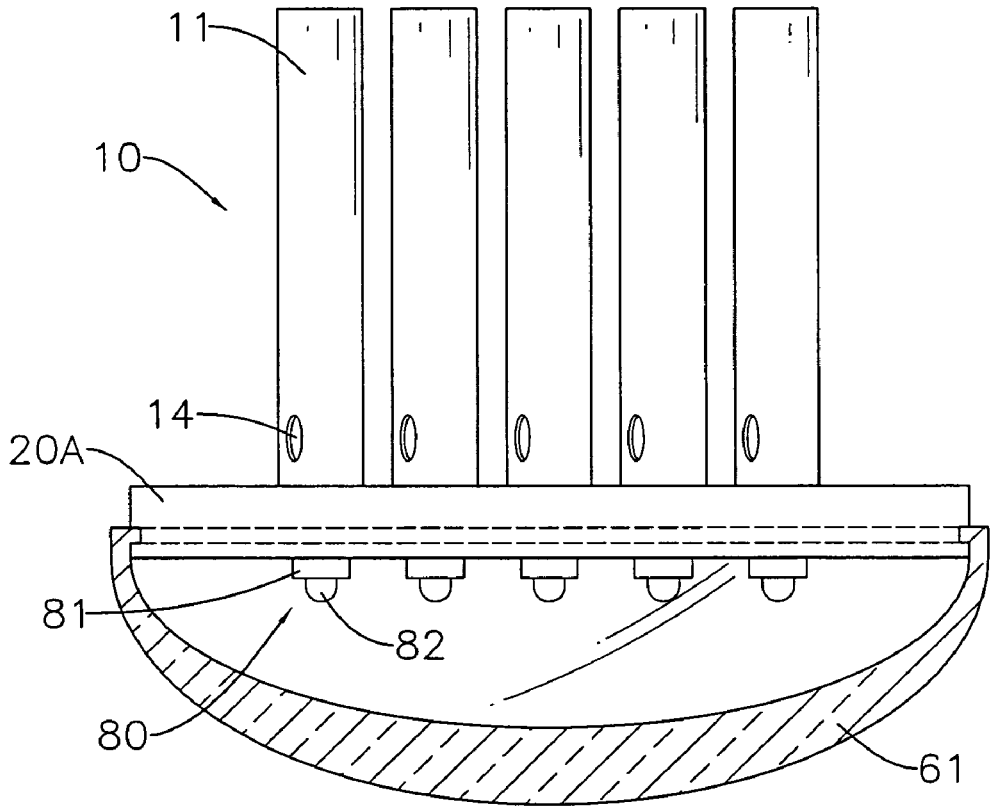
FIG. 7 is a side view in partial section of the streetlight in FIG. 6.

With further reference to FIGS. 6 and 7, an LED heat sink in accordance with the present invention may be used to make a luminous device (60) such as a street light or a high-illumination flash light. Multiple conducting blocks (20A) of multiple pipes (10) may be combined allowing multiple LED heat sinks to be mounted adjacently.

When heat is generated by the LED unit (80) during operation, the inlet end of the pipe is constantly heated and cooled by the heat being transported from the inlet end to the outlet end. With the aforementioned structure having an inlet (14), cooling air is effectively inhaled into the inlet (14) and flows through the pipe (10) to the outlet end along with the direction of heat-transportation. An air-cooling effect provided by the present invention enhances spreading dissipating efficiency, thus each LED device requires a relatively small individual or combined conducting block (20, 20A). Therefore, the conducting block (20) will not be unacceptably large, and the LED devices may intensively combined allowing the light emitted to be better of greater intensity to provide improved functionality of the luminous device (60).

Furthermore, when making the luminous device (60), a transparent lens cover (61) may be installed in front of the LED devices and focus emitted light to provide even better luminous effect.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An LED heat sink comprising
an LED unit comprising
a base having a top; and
an LED chip attached to top of the base; and
a pipe comprising
an inlet end being attached to the base of the LED unit;
an outlet end; and
a body having
an inner surface; and
an outer surface;
multiple inlets being defined near the base;
multiple partitioning walls being formed inside the body; and
multiple partitions being defined within the body by the partitioning walls, communicating with the inlet end and the outlet end and communicating respectively with the inlets; wherein
the pipe has an axis;
the body has an inner surface;
each partitioning wall protrudes radially from the axis to the inner surface;
the base is connected to the axis of the pipe and has an outer edge;
each inlet is formed between the outer edge and the body;
the axis further has a protruding shaft being connected to the base;
the shaft has
an outer surface; and
an outer thread formed on the outer surface;
the LED heat sink further has a conducting block being attached to the shaft and having a shaft recess being screwed to the shaft; and
the base is attached to the conducting block.

2. The LED heat sink as claimed in claim 1, wherein
the inner surface and the outer surface of the body are irregular.

3. The LED heat sink as claimed in claim 1, wherein
the inner surface and the outer surface of the body are irregular.

4. The LED heat sink as claimed in claim 1, wherein
the inner surface and the outer surface of the body are irregular.

5. The LED heat sink as claimed in claim 1, wherein
the inner surface and the outer surface of the body are irregular.

6. The LED heat sink as claimed in claim 1, wherein
the inner surface and the outer surface of the body are irregular.

* * * * *